US010720290B2

(12) United States Patent
Chan et al.

(10) Patent No.: US 10,720,290 B2
(45) Date of Patent: Jul. 21, 2020

(54) PNEUMATICALLY ACTUATED ROTARY SWITCH

(71) Applicant: NANNING FUGUI PRECISION INDUSTRIAL CO., LTD., Nanning (CN)

(72) Inventors: Chia-Hsun Chan, New Taipei (TW); Chia-Wei Fan, New Taipei (TW); Chien-Min Hung, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 16/218,795

(22) Filed: Dec. 13, 2018

(65) Prior Publication Data

US 2020/0194198 A1 Jun. 18, 2020

(51) Int. Cl.

| | |
|---|---|
| ***G05G 1/10*** | (2006.01) |
| ***H01H 3/08*** | (2006.01) |
| ***H01H 19/14*** | (2006.01) |
| ***H01H 19/20*** | (2006.01) |

(52) U.S. Cl.

CPC ..... *H01H 19/14* (2013.01); *G05G 1/10* (2013.01); *H01H 3/08* (2013.01); *H01H 19/20* (2013.01)

(58) Field of Classification Search

CPC . G05G 1/00; G05G 1/10; G05G 1/085; G06F 3/0202; G06F 3/03; H01H 3/08; H01H 19/14; H01H 19/20

See application file for complete search history.

(56) References Cited

U.S. PATENT DOCUMENTS

| | | | | |
|---|---|---|---|---|
| 4,131,033 | A * | 12/1978 | Wright | G05G 1/02 200/316 |
| 5,803,239 | A * | 9/1998 | Bray | H01H 1/60 200/242 |
| 7,804,036 | B2 * | 9/2010 | Ishigaki | B60K 37/06 200/336 |
| 9,543,092 | B2 | 1/2017 | Gourdet | |
| 9,557,761 | B2 * | 1/2017 | Sonmez | G05G 1/025 |
| 9,791,884 | B2 * | 10/2017 | Konno | G05G 1/08 |
| 10,276,316 | B2 * | 4/2019 | Turner | H01H 3/08 |
| 10,283,290 | B2 * | 5/2019 | Lydecker | H01H 19/585 |

FOREIGN PATENT DOCUMENTS

| | | | |
|---|---|---|---|
| CN | 204537890 | U | 8/2015 |
| EP | 3413328 | A1 | 12/2018 |
| WO | 2005034158 | A2 | 4/2005 |

* cited by examiner

*Primary Examiner* — Vanessa Girardi
(74) *Attorney, Agent, or Firm* — ScienBiziP, P.C.

(57) ABSTRACT

An electronic device includes a housing and a rotary switch received within the housing. The rotary switch includes a circuit board, a disk, a connecting shaft, and a pneumatic component. The connecting shaft protrudes from a central axis of the disk and connects to the circuit board. The pneumatic component is electrically coupled to the circuit board and includes an air chamber and a connecting rod. The connecting rod and the piston move together along the axis of the air chamber. The piston and the air chamber cooperatively define a sealed space. A circumference of the disk includes a number of protrusions. An engaging groove is defined between each two adjacent protrusions. A distance between a central axis of the disk and an inner wall of each engaging groove is different. The connecting rod selectively engages with a corresponding one of the engaging grooves.

13 Claims, 11 Drawing Sheets

PNEUMATICALLY ACTUATED ROTARY SWITCH

FIELD

The subject matter herein generally relates to rotary switches, and more particularly to a rotary switch of a translation device.

BACKGROUND

As shown in FIG. 1, a translation device generally has a microphone 110 and a main button 120. A user needs to press the main button 120 and speak into the microphone 110. Once the user releases the main button 120 after speaking, the translation device translates the speech. Generally, the translation device 100 is only able to translate speech of a first designated language into speech of a second designated language.

BRIEF DESCRIPTION OF THE DRAWINGS

Implementations of the present disclosure will now be described, by way of example only, with reference to the attached figures.

DETAILED DESCRIPTION

Figure 1:
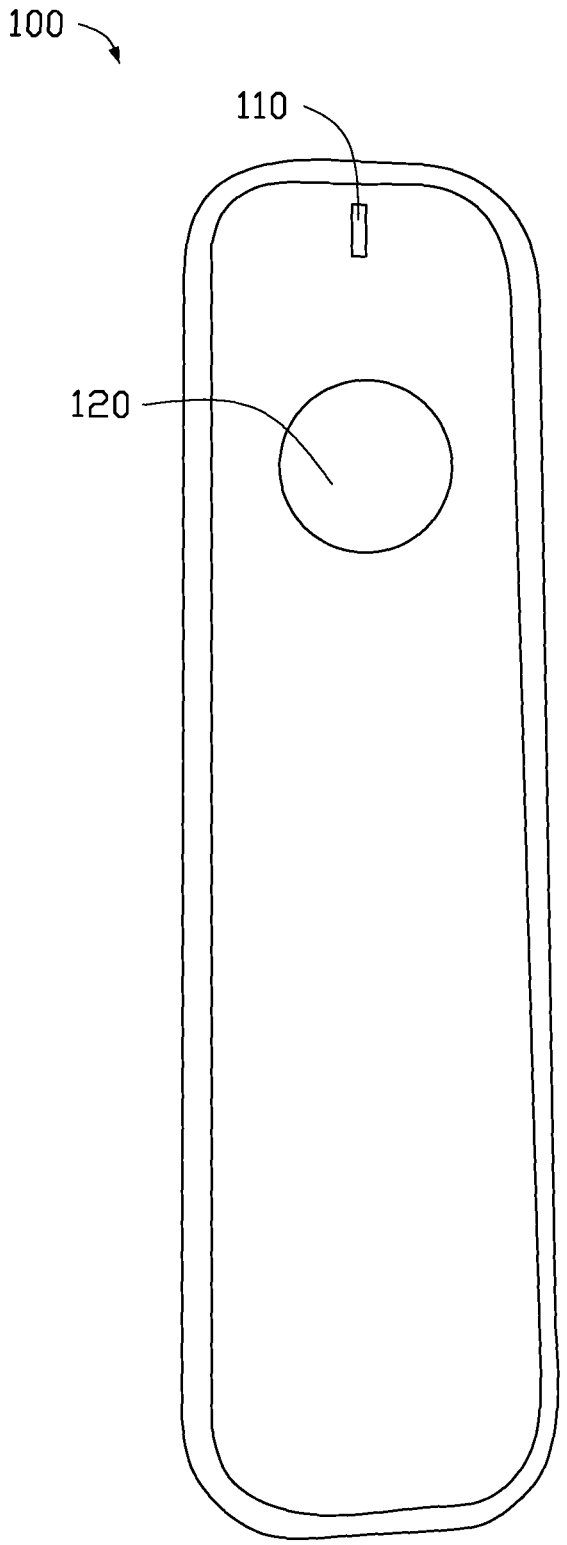
FIG. 1 is a diagram of a translation device of the prior art.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

Figure 2:
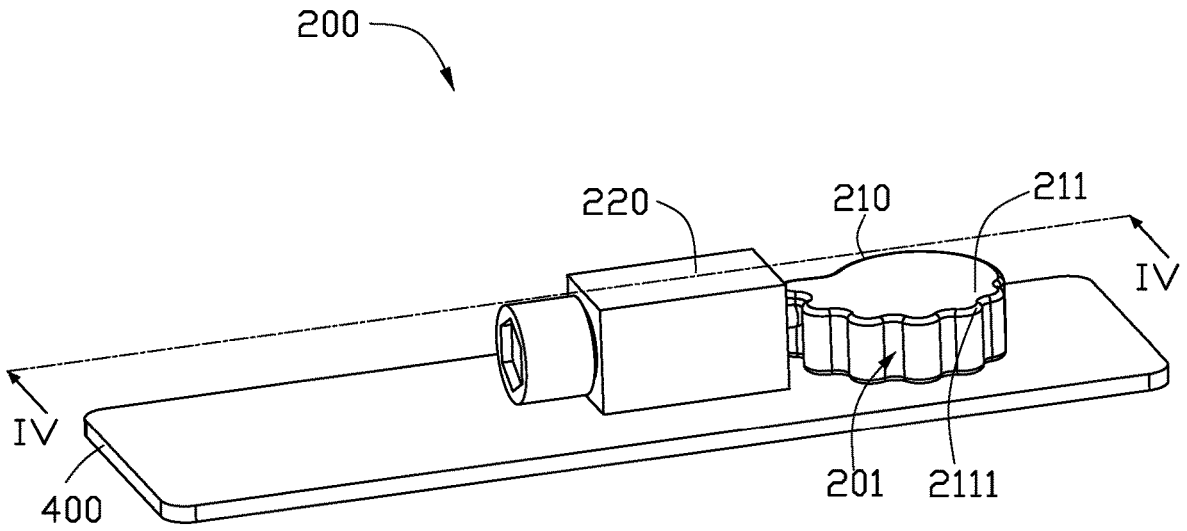
FIG. 2 is an assembled, isometric view of a rotary structure in accordance with an embodiment of the present disclosure.
Figure 3:
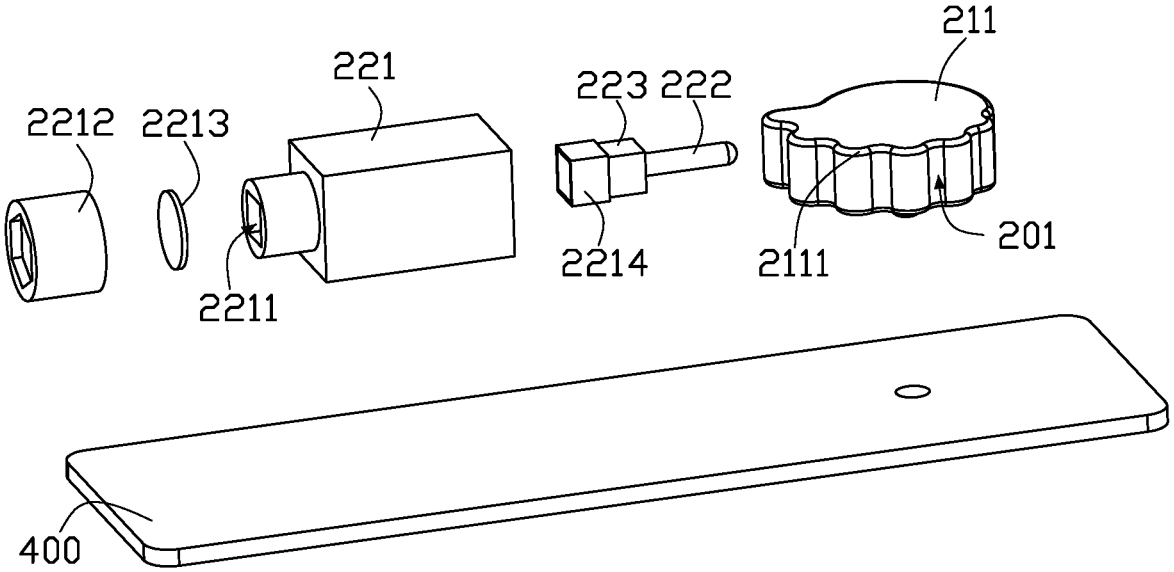
FIG. 3 is an exploded, isometric view of the rotary structure in FIG. 2.
Figure 4:
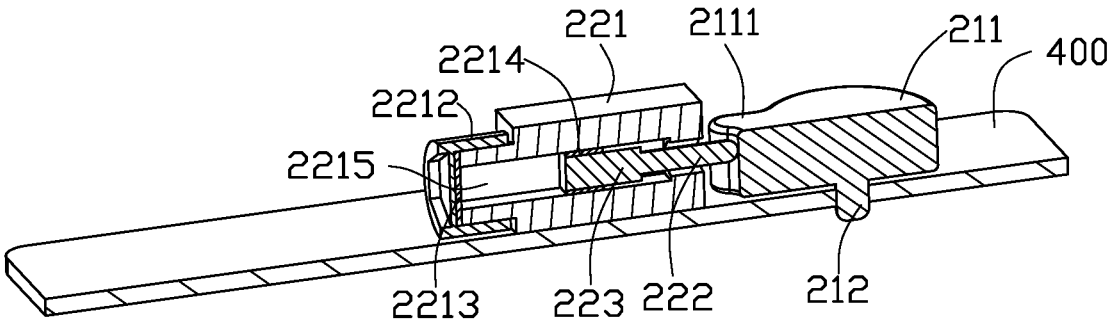
FIG. 4 is a cross-sectional view of the rotary structure taken along line IV-IV in FIG. 2.

FIGS. 2-4 show an embodiment of a rotary switch 200 for controlling functions of an electronic device according to air pressure differences.

The rotary switch 200 includes an indexing plate 210 and a pneumatic component 220. The indexing plate 210 includes a disk 211 and a connecting shaft 212. The connecting shaft 212 extends from a central axis of the disk 211 (shown in FIG. 4). The connecting shaft 212 is coupled to a circuit board 400. The pneumatic component 220 is electrically coupled to the circuit board 400 to convert pressure signals of the pneumatic component 220 into electrical signals. The pneumatic component 220 includes an air chamber 221 and a connecting rod 222. The connecting rod 222 extends along an axis of the air chamber 221. A first end of the connecting rod 222 extends out of the air chamber 221, and a second end of the connecting rod 222 is coupled to a piston 223. The connecting rod 222 and the piston 223 move together along the axis of the air chamber 221. The piston 223 and the air chamber 221 cooperatively define a sealed chamber. In the sealed chamber, $PV=nRT$. n represents moles of air particles, R is a coefficient. T is a temperature within the air chamber 221. Since n, R, and T do not change, P is inversely proportional to V. A circumference of the disk 211 includes a plurality of protrusions 2111. An engaging groove 201 is defined between each two adjacent protrusions 2111. A distance between a central axis of the disk 211 and an inner wall of each engaging groove 201 is different. In one embodiment, the distance between the central axis of the disk 211 and the inner wall of each of the engaging grooves 201 increases along a circumference of the disk 211. The first end of the connecting rod 222 selectively engages with a corresponding one of the engaging grooves 201.

Since the piston 223 and the air chamber 221 cooperatively define sealed space, the connecting rod 222 engaged with the different engaging grooves 201 along the circumference of the indexing plate 210 cause the connecting rod 222 to compress the piston 223 within the air chamber 221 at different lengths, which causes the volume and the pressure within the sealed space to change in an inversely proportional relationship. As shown in FIG. 4, as the piston 223 is moved toward the disk 211, a size of the sealed space increases within the air chamber 221, and the pressure is reduced. As the piston 223 moves away from the disk 211, the size of the sealed space decreases within the air chamber 221, and the pressure is increased. Thus, a pressure difference between the disk 211 in an initial position and the disk 211 in a rotated position generates a pressure signal to confirm a position of the rotary switch 200.

In one embodiment, the air chamber 221 defines an air hole 2211 in a side opposite from the indexing plate 210. To ensure a seal of the air chamber 221, a sealing cover 2212 is covered over the air hole 2211. A sealing cushion 2213 is located on an inner side of the sealing cover 2212. The sealing cushion 2213 may be made of rubber. The sealing cover 2212 uses the sealing cushion 2213 to ensure a sealing effect of the air chamber 221.

In another embodiment, a contact end of the piston 223 and the sealing cusion 2213 includes a sealing layer 2214 around a radial periphery thereof. When the piston 223 and the air chamber 221 include the sealing layer 2214, the sealing layer 2214 is in close contact with the sealing cushion 2213 to seal any gaps between the piston 223, the sealing cover 2212, and the air chamber 221.

The disk 211 includes the plurality of protrusions 2111. The radius of the disk 211 at the engaging grooves 201 increases along a circumference of the disk 211. The first end of the connecting rod 222 selectively engages with a corresponding one of the engaging grooves 201. Thus, as the rotary switch 200 is rotated, the connecting rod 222 compresses the piston 223 at different lengths, thereby changing the pressure within the air chamber 221. The pressure difference is converted into an electrical signal to determine the pressure of the piston 223, thereby confirming the position of the rotary switch 200.

Figure 5:
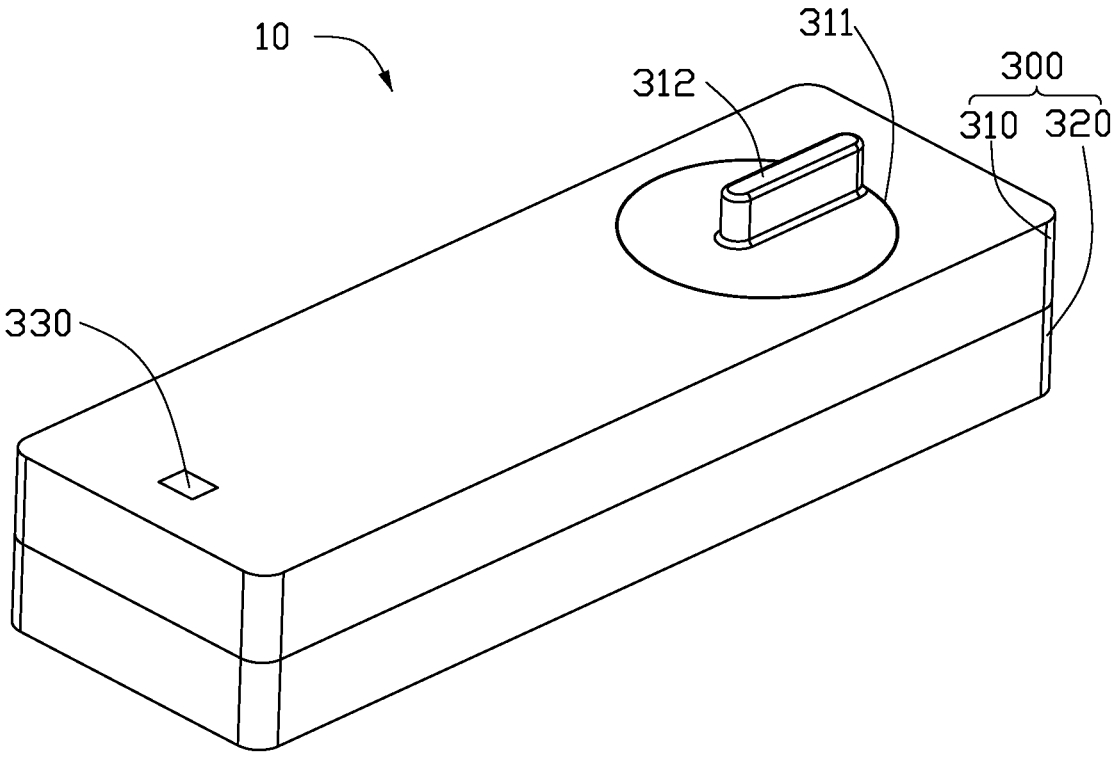
FIG. 5 is an isometric view of an electronic device including the rotary switch in accordance with an embodiment of the present disclosure.
Figure 6:
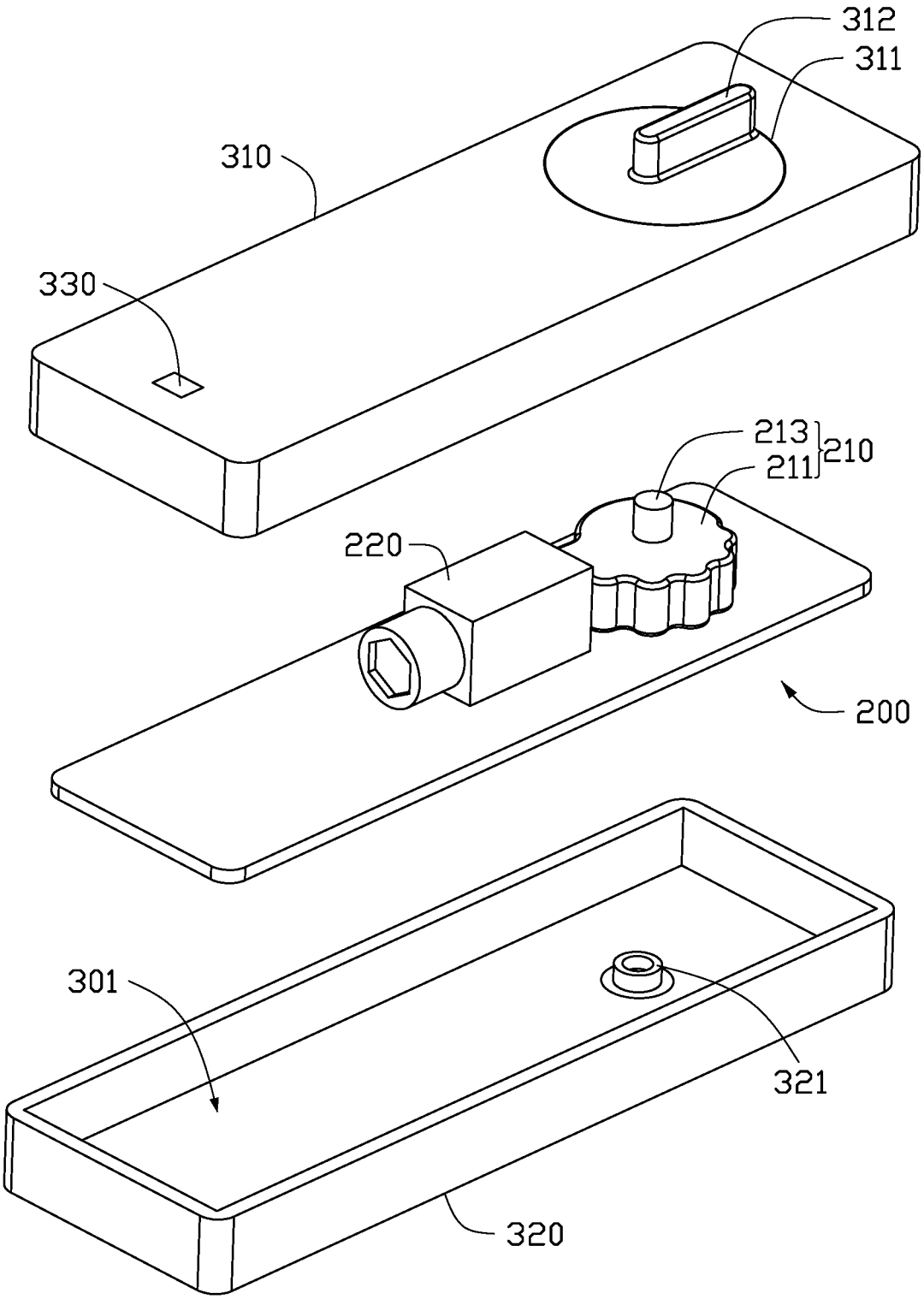
FIG. 6 is an exploded, isometric view of the electronic device in FIG. 5.

As shown in FIGS. 5-6, an electronic device 10 including the rotary switch 200 is provided. In one embodiment, the electronic device 10 is a translating device, but is not limited thereto. In another embodiment, the electronic device 10 is a recording pen. The electronic device 10 includes a housing 300. The rotary switch 200 is received within the housing 300. The housing 300 includes a first housing member 310 and a second housing member 320. The first housing member 310 and the second housing member 320 are coupled together and cooperatively define a component cavity 301 for receiving the rotary switch 200. The first housing 310 includes a rotary disk 311 on an outer surface thereof. The rotary disk 311 controls the rotary switch 200 to rotate. The disk 211 includes a rotary shaft 213 (shown in FIG. 4) extending opposite to the connecting shaft 212 and is coupled to the rotary disk 311. The rotary shaft 213 and the rotary disk 311 are coupled on an inner side of the first housing member 310. The rotary disk 311 drives the indexing disk 210 to rotate to control the rotary switch 200 to rotate. The first housing member 310 includes a handle 312 on the outer surface thereof for a user to grasp to rotate the rotary disk 311.

The circuit board 400 is mounted within the second housing member 320 by a mounting member 321. The mounting member 321 is coupled to the connecting shaft 212. The connecting shaft 212 rotates within the mounting member 321. The mounting member 321 not only mounts the circuit board 400, but also supports other components of the rotary switch 200.

In one embodiment, the housing 300 includes a text recognition system 330 located at a bottom portion of the housing 300. The text recognition system 330 may be a scanning system for scanning text or images containing text for translating. After scanning, the electronic device 10 translates according to the position of the rotary switch 200.

Figure 7:
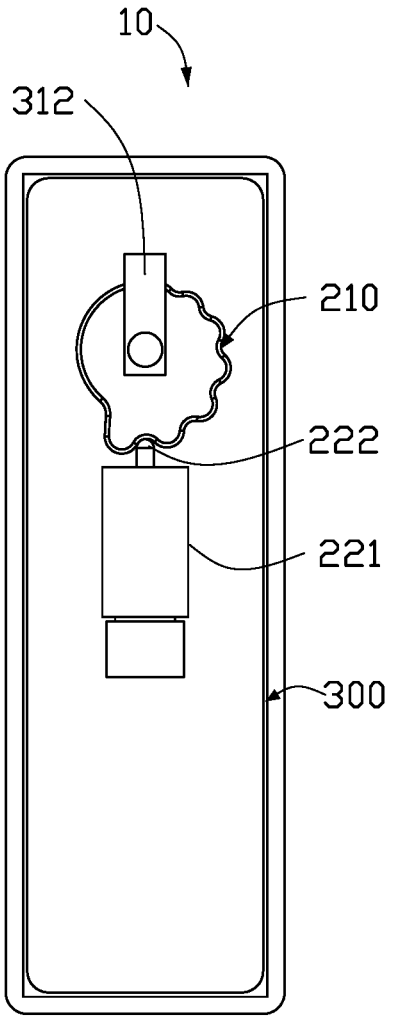
FIG. 7 is a diagram of the electronic device in FIG. 5 in an initial position.
Figure 8:
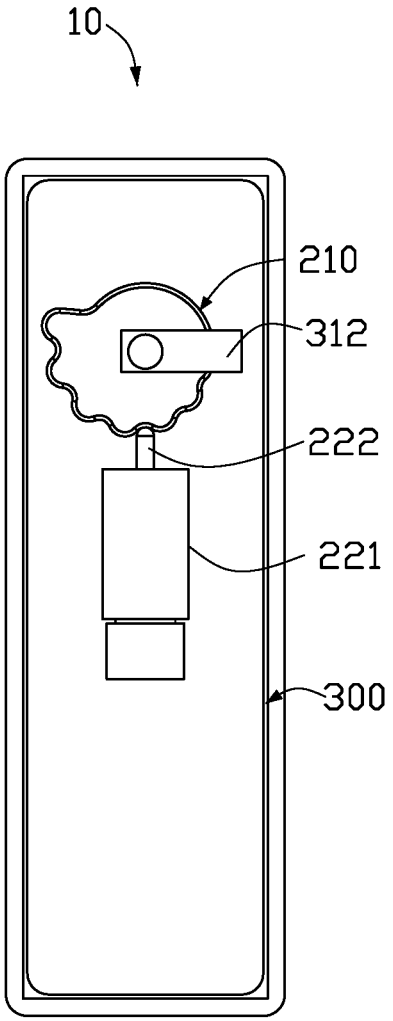
FIG. 8 is a diagram of the electronic device in FIG. 5 in another position.
Figure 9:
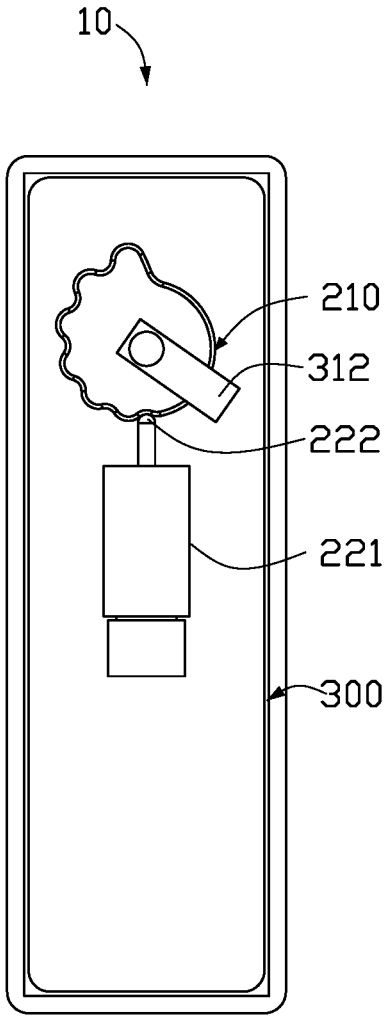
FIG. 9 is a diagram of the electronic device in FIG. 5 in another position.

FIGS. 7-9 show different states of the rotary switch 200. As shown in FIG. 7, the indexing disk 210 is in an initial position, and the electronic device 10 is in a standby mode. The radius of the indexing disk 210 has a largest radius at the engaging groove 201. A pressure of the air chamber 221 is an initial pressure and has a greatest pressure value.

As shown in FIG. 8, the rotary disk 311 is rotated, the radius of the indexing disk 210 has a smaller radius at the engaging groove 201. The pressure of the air chamber 221 decreases. The pressure is a second pressure value. A difference between the initial pressure value and the second pressure value is converted into an electrical signal to control a corresponding control system.

As shown in FIG. 9, the rotary disk 311 is rotated further, the radius of the indexing disk 210 has a smallest radius at the engaging groove 201. The pressure of the air chamber 221 decreases further. The pressure is a third pressure value. A difference between the initial pressure value and the third pressure value is converted into an electrical signal to control a corresponding control system.

Figure 10:
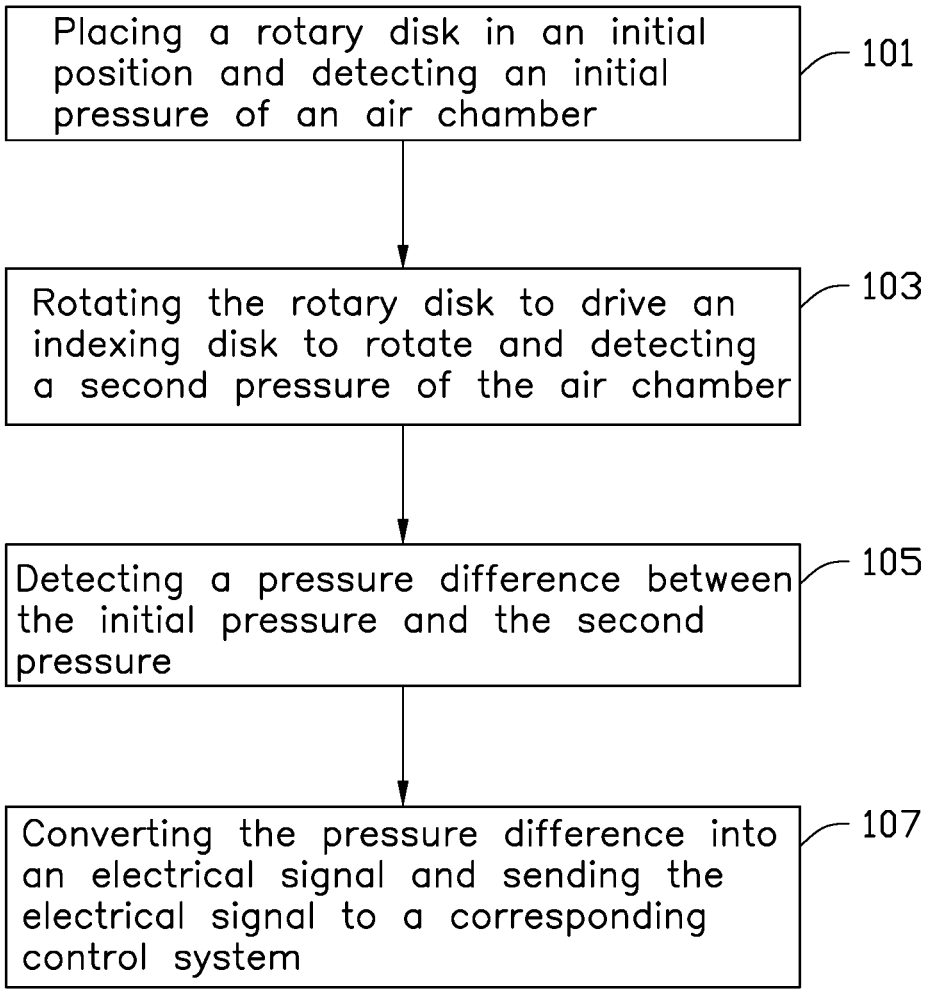
FIG. 10 is a flowchart diagram of a method for operating an electronic device including the rotary switch.

FIG. 10 illustrates a flowchart of an exemplary method for using an electronic device 10. The example method is provided by way of example, as there are a variety of ways to carry out the method. The method described below can be carried out using the configurations illustrated in FIGS. 1-9, for example, and various elements of these figures are referenced in explaining the example method. Each block shown in FIG. 10 represents one or more processes, methods, or subroutines carried out in the example method. Furthermore, the illustrated order of blocks is by example only, and the order of the blocks can be changed. Additional blocks can be added or fewer blocks can be utilized, without departing from this disclosure. The example method can begin at block S101.

At block S101, the indexing plate 210 is placed in an initial position. In the initial position, the connecting rod 222 engages with a first engaging groove 201, and an initial pressure in the air chamber 221 is detected while the rotary disk 311 is in the initial position.

At block S103, the indexing plate 210 is rotated via the rotary disk 311 from the initial position to a second position. In the second position, the connecting rod 222 engages with a second engaging groove 201, and an adjusted pressure in the air chamber 221 is detected while the rotary disk 311 is in the second position.

At block S105, a pressure difference between the initial pressure and the second pressure is detected.

At block S107, a pressure difference between the initial pressure and the adjusted pressure is determined, and the pressure difference is converted into an electrical signal and sent to a corresponding control system of the electronic device 10.

Figure 11:
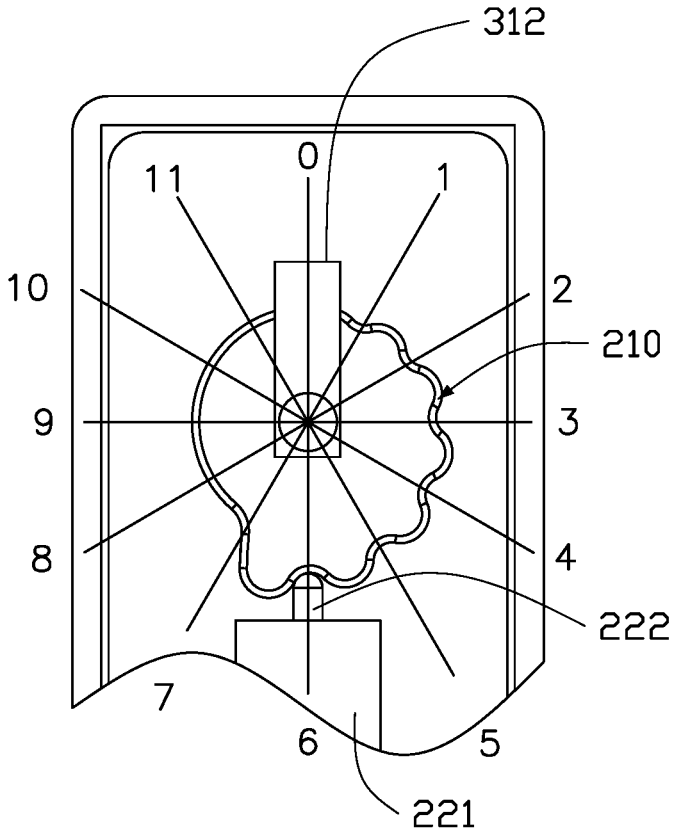
FIG. 11 is a diagram of every position of the electronic device in FIG. 5.

As shown in FIG. 11, when the handle 312 is placed in a 0 position, the electronic device 10 is in a standby mode. When the handle 312 is in a 1 position, the electronic device 10 is in a Chinese translation mode. When the handle 312 is in a 2 position, the electronic device 10 is in an English translation mode. When the handle 312 is in a 3 position, the electronic device 10 is in a Japanese translation mode. When the handle 312 is in a 4 position, the electronic device 10 is in a Korean translation mode. When the handle 312 is in a 5 position, the electronic device 10 is in a French translation mode. When the handle 312 is in a 6 position, the electronic device 10 is in a Spanish translation mode. When the handle 312 is in a 7 position, the electronic device 10 starts the text recognition system 330. When the handle 312 is in a 8 position, the electronic device 10 is in a restricted function. When the handle 312 is in a 9 position, the electronic device 10 is in a pending state to allow a user to confirm a final translation function. When the handle 312 is in a 10 position, the electronic device 10 is in a rescue mode. When the handle 312 is in an 11 position, the electronic device 10 is in a confirmation mode, and the electronic device 10 begins to translate the text or scanned text into the required language.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. A rotary switch, comprising:

a circuit board;

an indexing plate comprising a disk and a connecting shaft, the connecting shaft protruding from a central axis of the disk and connecting to the circuit board;

a pneumatic component electrically coupled to the circuit board and comprising an air chamber and a connecting rod, the connecting rod arranged along an axis of the air chamber, a first end of the connecting rod extending out of the air chamber, a second end of the connecting rod coupled to a piston, the connecting rod and the piston moving together along the axis of the air chamber, the piston and the air chamber cooperatively defining a sealed space; wherein:

a circumference of the disk comprises a plurality of protrusions;

an engaging groove is defined between each two adjacent protrusions;

a distance between a central axis of the disk and an inner wall of each engaging groove is different; and the connecting rod selectively engages with a corresponding one of the engaging grooves.

2. The rotary switch of claim 1, wherein the air chamber is a sealed chamber.

3. The rotary switch of claim 1, wherein the distance between the central axis of the disk and the inner wall of each engaging groove increases along a periphery of the disk.

4. The rotary switch of claim 1, further comprising a sealing cover having a sealing cushion on an inner side thereof, wherein:

the air chamber defines an air hole in a side opposite the indexing plate, and the sealing cover covers the air hole.

5. The rotary switch of claim 4, wherein a contact end of the piston and the sealing cushion comprises a sealing layer located around a radial periphery thereof.

6. An electronic device comprising:

a housing comprising a first housing member and a second housing member assembled together and cooperatively defining a component cavity; and a rotary switch received within the component cavity, the rotary switch comprising:

a circuit board;

an indexing plate comprising a disk and a connecting shaft, the connecting shaft protruding from a central axis of the disk and connecting to the circuit board;

a pneumatic component electrically coupled to the circuit board and comprising an air chamber and a connecting rod, the connecting rod arranged along an axis of the air chamber, a first end of the connecting rod extending out of the air chamber, a second end of the connecting rod coupled to a piston, the connecting rod and the piston moving together along the axis of the air chamber, the piston and the air chamber cooperatively defining a sealed space; wherein:

a circumference of the disk comprises a plurality of protrusions;

an engaging groove is defined between each two adjacent protrusions;

a distance between a central axis of the disk and an inner wall of each engaging groove is different;

the connecting rod selectively engages with a corresponding one of the engaging grooves; and the first housing member comprises a rotary disk on an outer surface thereof, the rotary disk coupled to the indexing plate and controlling the rotary switch.

7. The electronic device of claim 6, wherein the air chamber is a sealed chamber.

8. The electronic device of claim 6, wherein the distance between the central axis of the disk and the inner wall of each engaging groove increases along a periphery of the disk.

9. The electronic device of claim 6, wherein the housing comprises a text recognition system.

10. The electronic device of claim 6, wherein:

the disk comprises a rotary shaft extending opposite to the connecting shaft and is coupled to the rotary disk;

the rotary disk drives the indexing plate to rotate;

the rotary disk comprises a handle on a top surface thereof.

11. The electronic device of claim 10, wherein the piston stopped in different positions changes a volume of the air chamber.

12. The electronic device of claim 10, wherein the circuit board is mounted within the second housing member by a mounting member.

13. The electronic device of claim 12, wherein a contact end of the piston and the sealing cushion comprises a sealing layer located around a radial periphery thereof.

* * * * *